US005908006A

United States Patent [19]

Ibata

[11] Patent Number: 5,908,006

[45] Date of Patent: Jun. 1, 1999

[54] ADJUSTABLE SPONSON FOR WATERCRAFT

[75] Inventor: Toshiaki Ibata, Peachtree City, Ga.

[73] Assignee: Yamaha Hatsudoki Kabushiki Kaisha, Japan

[21] Appl. No.: 09/016,200

[22] Filed: Jan. 30, 1998

Related U.S. Application Data

[63] Continuation of application No. 08/711,342, Sep. 5, 1996, Pat. No. 5,713,297.

[51] Int. Cl.[6] ..... B63B 1/22

[52] U.S. Cl. ..... 114/284; 114/123; 114/343; 114/270

[58] Field of Search ..... 114/270, 123, 114/126, 271, 283–287, 343

[56] References Cited

U.S. PATENT DOCUMENTS

| | | | |
|---|---|---|---|
| 1,075,726 | 10/1913 | Prosser | 114/283 |
| 2,832,304 | 4/1958 | Elyosius et al. . | |
| 2,919,669 | 1/1960 | Kikuhara . | |
| 3,106,178 | 10/1963 | Cale . | |
| 3,115,860 | 12/1963 | Payne . | |
| 3,159,131 | 12/1964 | Frederick | 114/285 |
| 3,481,297 | 12/1969 | Mantle . | |
| 4,320,713 | 3/1982 | Nishida et al. . | |
| 4,458,622 | 7/1984 | Anderson . | |
| 4,909,176 | 3/1990 | Kobayashi . | |
| 5,313,907 | 5/1994 | Hodges . | |
| 5,713,297 | 2/1998 | Tani et al. | 114/284 |

FOREIGN PATENT DOCUMENTS

| | | |
|---|---|---|
| 84 19306 | 6/1986 | European Pat. Off. . |
| 357644 | 6/1921 | Germany . |
| 5-238476 | 9/1993 | Japan . |
| 6-191466 | 7/1994 | Japan . |

OTHER PUBLICATIONS

McKercher, "Getting A Handle" article, *Personal Watercraft Illustrated,* vol. 9, No. 1, Jan. 1995 pp. 68–72.

"Doo–ing the Twist" advertisement, *Splash* magazine, vol. 8, No. 5, May 1995.

*Primary Examiner*—Jesus D. Sotelo

*Attorney, Agent, or Firm*—Knobbe, Martens, Olson & Bear LLP

[57] ABSTRACT

An adjustable sponson for a watercraft includes a coupling mechanism that allows the angular orientation of the sponson body relative to the hull of the watercraft to be varied by the operator of the watercraft without the use of any tools. The coupling mechanism also secures the sponson to the hull of the watercraft, maintaining the desired orientation of the sponson.

8 Claims, 10 Drawing Sheets

ADJUSTABLE SPONSON FOR WATERCRAFT

This is a continuation of U.S. patent application Ser. No. 08/711,342, filed Sep. 5, 1996, now U.S. Pat. No. 5,713,297, issued on Feb. 3, 1998.

BACKGROUND OF THE INVENTION

1. Field of the Invention

The present invention relates in general to a watercraft. In particular, the present invention relates to an improved sponson design for a watercraft.

2. Description of Related Art

Personal watercraft have become very popular in recent years. An enthusiasm for competition has grown with this popularity, and as a result, personal watercraft have become increasingly faster. Many personal watercraft today are capable of traveling at speeds above 60 mph. At such speeds, however, some watercraft, especially those with modified engines, tend not to provide the stability that many riders prefer. High-performance personal watercraft also tend not to respond in a manner that many riders desire.

To improve the stability and the handling characteristics of the watercraft at high speeds, many personal watercraft now include sponsons. A sponson is an elongated rib attached to a side of the personal watercraft hull. Personal watercraft generally include a pair of sponsons which are positioned on opposite sides of the watercraft at the same position and in the same angular orientation relative to the outer chines of the watercraft hull. Some sponsons are integrally formed with the hull when the watercraft hull is molded. Other sponsons are fixed to the hull in a set position and angular orientation relative to the hull outer chines by conventional fasteners, e.g., screws.

Sponsons give a personal watercraft greater stability by creating greater hull surface area when the watercraft is up on plane. The effective hull surface area at high speeds offers greater stability and gives the rider the feeling that the personal watercraft is wider than its actual width.

The sponsons also improve the handling characteristics of the personal watercraft. The sponsons counteract the rider's shifted weight when turning, thereby allowing the rider to lean into a turn. By positioning the sponsons at points on the hull sides which lie below the water line when the watercraft is turning, the turning or handling characteristics of the watercraft also become more aggressive; a low position of the sponsons on the hull sides makes the watercraft more responsive.

The optimum placement of the sponsons on a personal watercraft varies with the rider's size, the rider's riding style, the number of riders, and riding conditions (i.e., water roughness). No perfect placement of the sponsons on the watercraft exists to maximize the stability and handling characteristics of the watercraft for every rider and under every riding condition. Previous sponson placement has been selected to produce a particular riding style, which of course does not suit every rider of the watercraft.

This problem is compounded when the watercraft is used by both single and multiple riders. Varying the number of riders gives rise to different loadings of the watercraft in a fore-and-aft direction, and the ideal position of the sponsons changes depending upon the number of riders.

SUMMARY OF THE INVENTION

A need therefore exists for an adjustable sponson which can be easily and readily adjusted to tailor the responsiveness and the stability of the watercraft depending upon the size and riding style of the rider and depending upon the number of riders.

An aspect of the present invention therefore involves an adjustable sponson adopted for use with a watercraft hull. The adjustable sponson includes a sponson body and a coupling mechanism which attaches the sponson body to the watercraft hull. The coupling mechanism comprises a guide mechanism that generally defines a travel path for at least a portion of the sponson body over a surface of the hull. A drive mechanism operable between the watercraft hull and the sponson body to move at least a portion of the body sponson along the travel path.

In accordance with another aspect of the present invention, an adjustable sponson for use on a watercraft hull comprises an elongated body having fore and aft ends. A front coupling connects the fore end of the body to rotatably couple the fore end to the watercraft hull. Means are provided for raising and lowering the aft end of the sponson body relative to the fore end while coupling the aft end to the watercraft hull.

An additional aspect of the present invention involves a watercraft having a hull comprising an adjustable hull component. The adjustable hull component comprises a body movably attached to the watercraft hull by a guide mechanism. The guide mechanism generally defines a travel path for at least a portion of the body over a surface of the hull. A drive mechanism operates between the watercraft hull and the body to move at least a portion of the body along the travel path. A locking mechanism selectively inhibits movement of the body relative to the watercraft hull.

In accordance with another aspect of the present invention, an adjustable sponson is provided for use with a watercraft hull. The adjustable sponson includes a sponson body and a mounting device which attaches at least a portion of the sponson body to the watercraft hull. The mounting device is contained within a cavity formed within the sponson body and not protruding outwardly from the sponson body in a direction away from the watercraft hull.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF PREFERRED EMBODIMENTS

Figure 1:
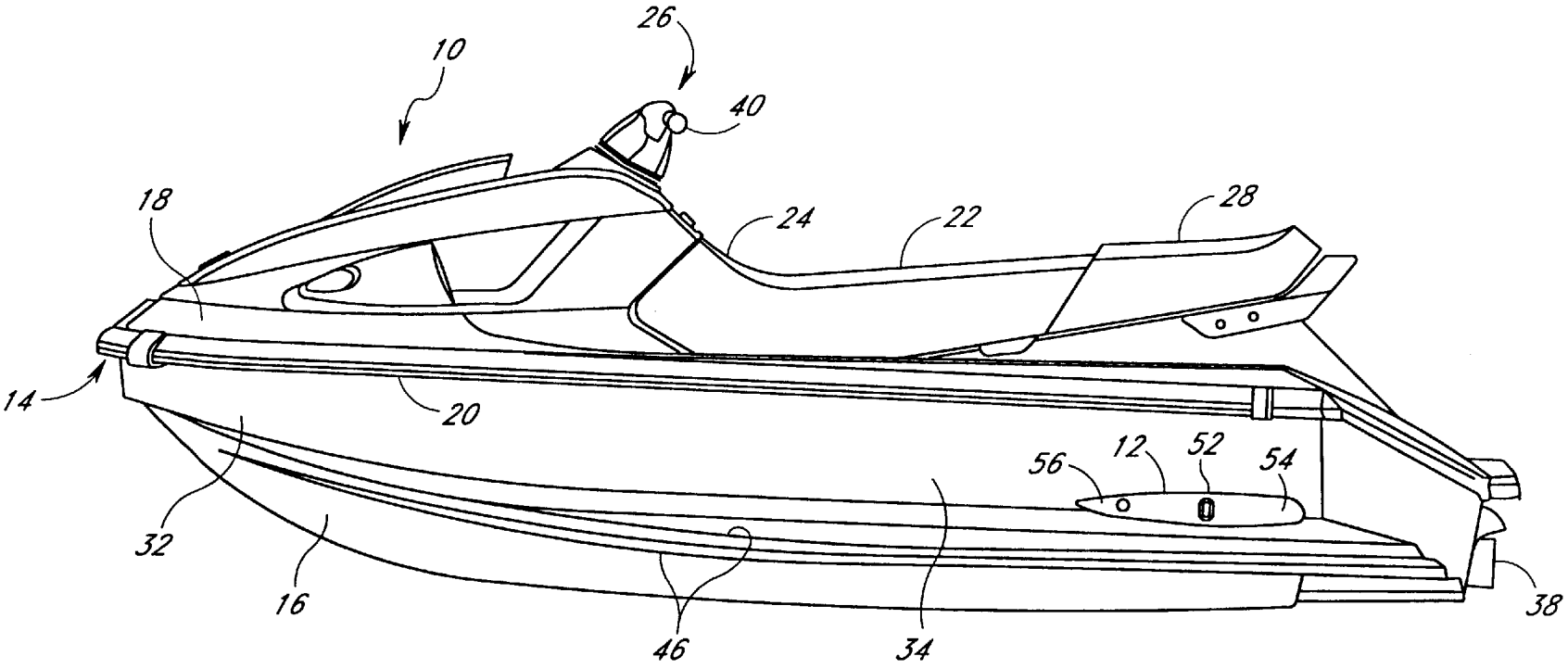
FIG. 1 is a port side elevational view of an exemplary watercraft which includes adjustable sponsons configured in accordance with a preferred embodiment of the present invention.
Figure 2:
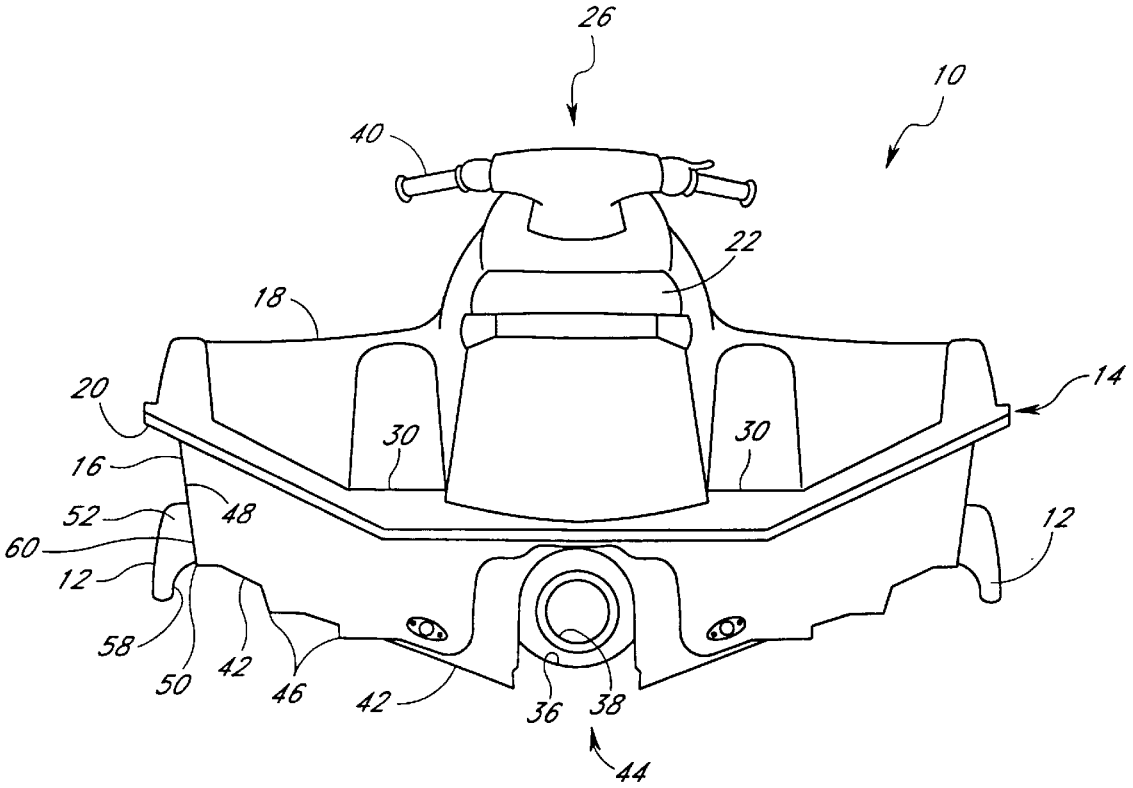
FIG. 2 is a rear elevational view of the watercraft of FIG. 1.

FIGS. 1 and 2 illustrate a personal watercraft 10 which includes a pair of adjustable sponsons 12 configured in accordance with a preferred embodiment of the present invention. Although the present adjustable sponson 12 is illustrated in connection with a personal watercraft, the adjustable sponson 12 can be used with other types of watercraft as well, such as, for example, but without limitation, small jet boats and the like.

Before describing the adjustable sponson 12, an exemplary personal watercraft 10 will first be described in general details to assist the reader's understanding of the environment of use and the operation of the adjustable sponson 12. The watercraft 10 includes a hull 14 formed by a lower hull section 16 and an upper deck section 18. The hull sections 16, 18 are formed from a suitable material such as, for example, a molded fiberglass reinforced resin. The lower hull section 16 and the upper deck section 18 are fixed to each other around the peripheral edges 20 in any suitable manner.

A passenger seat 22 is provided proximate to the stem of the hull 14. The passenger seat 22 is mounted longitudinally along the center of the watercraft 10. In the illustrated embodiment, the seat 22 has a longitudinally extended straddle-type shape which may be straddled by an operator and by at least one or two passengers. A forward end 24 of the seat 22 lies proximate to the controls 26 of the watercraft 10 which generally lie at about the longitudinal center of the watercraft 10. This position of the operator on the watercraft 10 gives the watercraft fore and aft balance when the operator rides alone. A rear portion 28 of the seat 22 is configured to allow one or two passengers to be comfortably seated behind the operator of the watercraft 10. The seat 22 desirably includes a removable seat cushion to increase the comfort of the operator and the passengers.

The upper deck section 18 of the hull 14 advantageously includes foot areas 30. The foot areas 30 extend generally longitudinally and parallel to the sides of the elongated seat 22 so that the operator and any passengers sitting on the seat 22 can place their feet in the foot areas 30. A non-slip surface (not shown) is located in the foot areas 30 to provide increased grip and traction for the operator and the passengers.

The lower hull section 16 of the personal watercraft 10 includes a forward compartment 32 and a rear compartment 34. In the exemplary watercraft depicted in FIG. 1, a fuel tank and a buoyant block (not illustrated) are located in the forward compartment 32. The buoyant block affords additional buoyancy to the watercraft 10. An internal combustion engine (not shown), which powers the watercraft 10, is located in the rear compartment 34 beneath the front end 24 of the seat 22. A battery can be positioned proximate to the engine to provide a source of electrical power for accessories of the watercraft 10 and for starting the engine. The cushion of the seat 22 desirably can be removed to provide access to the engine and the battery.

The engine drives a jet propulsion unit (not shown) to propel the watercraft 10. The jet propulsion unit is positioned in a tunnel 36 (FIG. 2) in the rear center of the lower hull section 16. The engine output shaft drives an impeller of the propulsion unit. If the engine output shaft is vertically disposed, the impeller will be driven through a bevel gear transmission or a similar transmission.

The water which is pressurized within the tunnel by the impeller is discharged through a steering nozzle 38. The steering nozzle 38 is pivotally supported at the rear of the jet propulsion unit to change the thrust angle on the watercraft 10 for steering purposes as is known in the art.

The steering nozzle 38 is connected to a steering handle 40. The steering handle 40 forms part of the operator controls 26 which are mounted in front of the operator seat 24 as noted above. The steering handle 40 also can include a throttle control for controlling the speed of the engine.

As best understood from FIG. 2, the lower hull section 16 generally has a "V"-bottom formed by a pair of angularly disposed surfaces 42 which extend outwardly. The surfaces 42 extend outwardly from a central recess section 44 which forms a portion of the tunnel section 36 at the rear of the lower hull section 16. Each angularly disposed surface 42 of the lower hull section 16 can include one or more inner chines 46 as is known in the art.

The central recessed section 44 includes the water inlet port (not shown) for the jet propulsion unit. The downwardly facing inlet is located proximate the rear of the watercraft 10 and communicates with the body of water in which the watercraft 10 is operated. The jet propulsion unit thus draws water through the inlet and into the tunnel 36.

The angularly disposed surfaces 42 terminate at longitudinally extending side walls 48. The side walls 48 are inclined more steeply than the angularly disposed surfaces 42. The side walls 48 are generally flat and straight near the stem of the watercraft hull 14 and smoothly bend toward the longitudinal center of the watercraft 10 toward the bow. The lines of intersection between the angularly disposed surfaces 42 and the corresponding side walls 48 form outer chines 50 of the lower hull section 16.

The personal watercraft 10 so far described is conventional and represents only an exemplary watercraft on which the present adjustable sponsons 12 can be employed. A further description of the personal watercraft 10 therefore is not believed necessary for an understanding and an appreciation of the present adjustable sponsons 12. The adjustable sponsons 12 will now be described in detail.

In the illustrated embodiment of FIGS. 1 and 2, the personal watercraft 10 includes a pair of adjustable sponsons 12, although the watercraft 10 can include any number of adjustable sponsons 12 in order to suit a particular application or loading condition. As understood from FIGS. 1 and 2, a starboard side sponson 12 extends from the starboard side 48 of the lower hull section 16 and a port side sponson 12 extends from the port side 48 of the lower hull section 16.

Each sponson 12 desirably is attached above the outer chine 50 on the corresponding side of the lower hull section 16 of the watercraft 10. The sponsons 12 are positioned proximate the stem of the watercraft 10 and extend outwardly for increased buoyancy and stability. The angular orientation of the sponsons 12 relative to the outer chines 50 are desirably the same for both sponsons, however, the sponsons 12 can be set at different angular orientations to give the watercraft 10 different handling characteristics depending upon the turning direction.

It is contemplated that the structure of port and starboard side adjustable sponsons 12 will be identical apart from the sponson bodies being mirror images of each other. The description herein of one adjustable sponson therefore will be understood as applying equally to both unless specified to the contrary.

Figure 3:
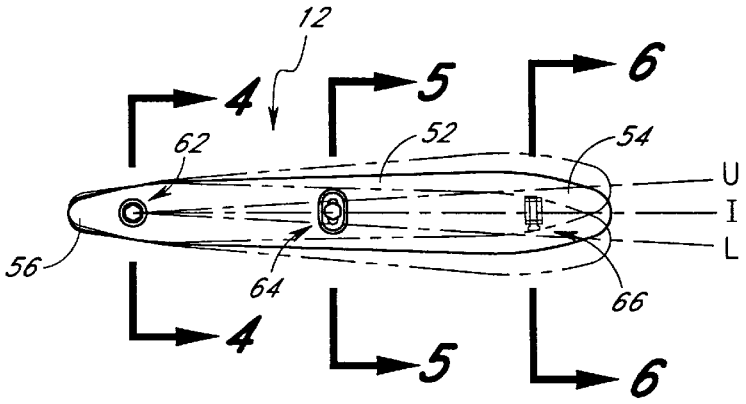
FIG. 3 is a side elevational view of the adjustable sponson of FIG. 1 schematically illustrating various angular orientations of the sponson.

As best seen in FIGS. 1–3, the sponson 12 has an elongated rib-like body 52 with a length substantially shorter than the length of the hull 14. In the illustrated embodiment, the sponson 12 has a length roughly equal to about ⅙th the length of the watercraft 10. For heavier watercraft or for watercraft designed to accommodate multiple passengers, however, longer sponsons can be used.

The shape of the sponson body 52 tapers from its aft end 54 to a generally blunt nose 56 positioned at the fore end to give the body a substantially streamline shape in the direction of water flow over the sponson 12. In other words, the lateral width of the sponson body 52 increases from its blunt nose 56 to its aft end 54.

As best seen in FIG. 2, an outer portion at the aft end 54 of the sponson body 52 protrudes downward to give the sponson 12 a generally fin-like shape. The sponson 12 also includes an arcuate lower surface 58 formed on the underside of the sponson body 52. The arcuate lower surface 58 extends away from the side 48 of the lower hull section 16.

The outer portion of the sponson body 52 also tapers in size in the vertical direction such that the outer portion smoothly transitions into the blunt nose 56 of the sponson 12 in the forward direction. That is, the degree to which the sponson body 52 protrudes downwards decreases gradually toward its fore end 56 and blends smoothly into the fore end 56. The fore end 56 of the sponson body 52 does not significantly protrude downwardly, if at all.

The size and shape of the sponson body 52 desirably is selected according to the preference of the particular rider and the number of riders. It is contemplated that other shapes and sizes of the sponson body 52 can be used.

As best seen in FIG. 2, the sponson body 52 includes a generally flat inner mounting surface 60 which abuts the side 48 of the lower hull section 16 when assembled. A coupling mechanism of the adjustable sponson 12 couples the sponson body 52 to the lower hull section 16 and allows for adjustment of the angular orientation of the sponson body 52 relative to the corresponding outer chine 50 of the hull lower section 16, as described below.

In the illustrated embodiment of FIG. 3, the coupling mechanism includes a front coupling 62, a mid coupling 64, and an aft coupling 66. The couplings 62, 64, 66 of the coupling mechanism allow the sponson body 52 to move relative to the watercraft hull side 48 to adjust the angular orientation of the sponson body 52. The coupling mechanism can include either fewer or greater number of couplings for this purpose.

Figure 4:
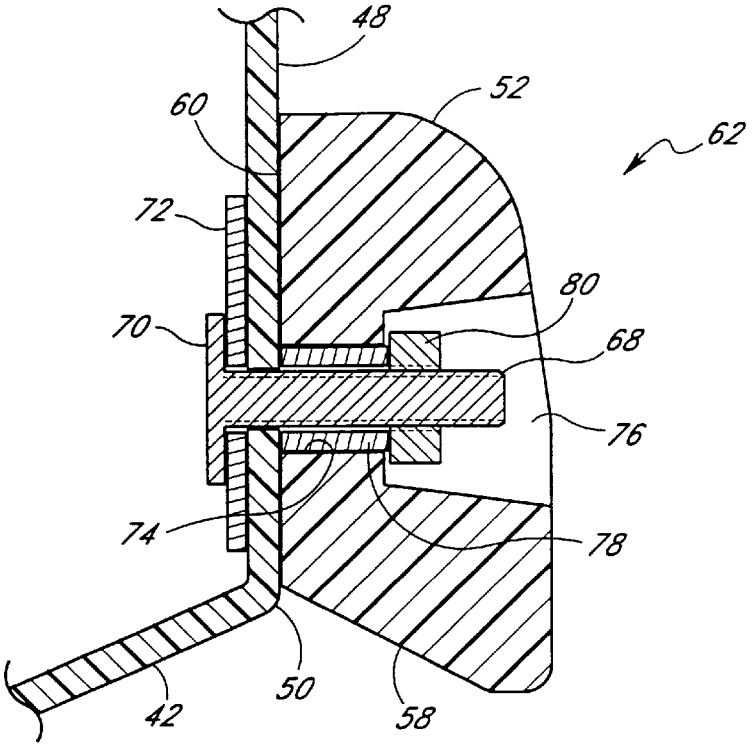
FIG. 4 is a cross-sectional view of a front coupling mechanism of the sponson taken along line 4—4 of FIG. 3.

With reference to FIGS. 3 and 4, the front coupling 62 includes a threaded stud 68 with a flattened base 70. The stud 68 extends outwardly through an aperture formed in the side wall 48 of the hull lower section 16. The stud 68 also extends through an aperture formed in a mounting plate 72. The mounting plate 72 lies inside the hull 16, adjacent to the side wall 48 to reinforce the side wall 48 at this location. In this position, the mounting plate 72 is interposed between the base portion 70 of the stud 68 and the side wall 48 of the lower hull section 16. Though not illustrated, the base portion 70 of the stud 68 may be formed integral to the mounting plate 72 or affixed thereto by means of welds or the like so as to dispose the mounting plate 72 and studs 68 within the lower hull 16 as a single component. The diameter of the aperture in the mounting plate 72 is slightly larger than the diameter of the stud 68 which allows the stud 68 to freely extend through the mounting plate 72. The diameter of the opening formed in the side wall 48 desirably is generally equal in size to the diameter of the portion of the stud 68 extending through the side wall 48. The generally tight fit between the stud 68 and the side wall aperture inhibit water flow into the lower hull 16 through the aperture. Although not illustrated, a grommet or an O-ring can be placed about or in the aperture to improve the seal between the stud 68 and the side wall 48.

An outer end of the stud 68 extends through a hole 74 formed at the fore end of the sponson body. The hole 74 extends into the sponson body 52 from the generally flat inner mounting surface 60 of the sponson body 52 and opens into a counterbore recess 76. The recess 76 extends into the sponson body 52 from the outer side of the sponson body 52, opposite of the hole 74.

A spacer 78 is placed in the opening 74 over the stud 68. The spacer 78 provides a bearing surface about which the fore end 56 of the sponson body 52 can rotate. The inner end of the spacer 78 abuts the side wall 48 of the hull 16 while its outer end extends slightly beyond the inner surface of the recess 76. A nut 80 is disposed within the recess 76 and threadingly engages the outer end of the stud 68 such that its inner side abuts the outer end of the spacer 78. The diameter of the nut 80 is less than the diameter of the recess 76, but greater than the diameter of the pivot stud 68 and the opening 74. Thus, with the above described pivot mechanism configuration, the sponson 12 may be rotated about the longitudinal axis of the stud 68 while its generally flat inner mounting surface 60 is held in close proximity to the side wall 48 of the hull lower section 16 by the nut 80.

Although not illustrated, the front coupling 62 can include a locking mechanism which positively locks the position of the fore end of the sponson body 52. Such a locking mechanism desirably includes a quick release and can be operated by hand.

Figure 5:
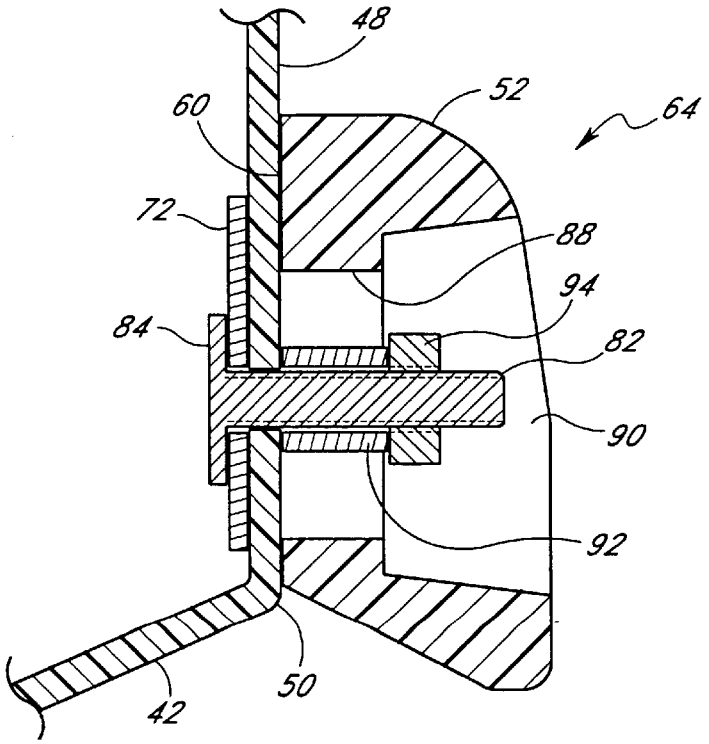
FIG. 5 is a cross-sectional view of a mid coupling mechanism of the sponson taken along line 5—5 of FIG. 3.

With reference to FIGS. 3 and 5, the mid coupling 64 in the illustrated embodiment includes a threaded stud 82 with a flattened base portion 84. The stud 82 extends outwardly through an aperture formed in the side wall 48 of the hull lower section 16. The stud 82 also extends through an aperture formed in the mounting plate 72, or may be formed integrally with the mounting plate 72. Also, while the above mounting plate 72 is described as a single mounting plate, it is understood that a dedicated mounting plate may be used by the fore and mid couplings 62, 64.

The diameter of the aperture in the mounting plate 72 is slightly larger than the diameter of the stud 82 which allows the stud 82 to freely extend through the mounting plate 72. The diameter of the opening formed in the side wall 48 desirably is generally equal in size to the diameter of the portion of the stud 82 extending through the side wall 48. The generally tight fit between the stud 82 and the side wall aperture inhibit water flow into the hull 16 through the aperture. Although not illustrated, a grommet or an O-ring also can be placed about or in the aperture to improve the seal between the stud 82 and the side wall 48.

The stud 82 also extends through a slot 88 formed in the middle portion of the generally flat inner mounting surface 60 of the sponson body 52. In the illustrated embodiment, the slot 88 generally has an elongated straight shape and lies with its longitudinal axis positioned generally transverse to the longitudinal axis of the sponson body 52; however, it is appreciated that other shapes (e.g., arcuate) and orientations of the slot also can be used in order to suit a particular application.

The slot 88 extends into the sponson body 52 from the mounting surface 60 and terminates at an inner surface of a recess 90. The recess 90 extends into the sponson body from the outer side, directly opposing the slot 88.

The width of the slot 88 is larger than the diameter of the stud 82 to permit the sponson body 52 to pivot about the longitudinal axis of the pivot shaft 68. In the illustrated embodiment, the length of the slot 88 is approximately 4 to 5 times the diameter of the stud 82. This allows the vertical position of the center portion of the sponson body 52 to move up or down relative to the stud 82.

A spacer 92 is disposed within the vertical slot 88 over the stud 82. The spacer 92 provides a bearing surface over which the mid section of the sponson body 52 can slide. The inner end of the spacer 92 abuts the side wall 48 while its outer end extends slightly beyond the inner surface of the recess 90. A nut 94 is disposed within the recess 90 and threadingly engages the outer end of the stud 82 such that its inner side abuts the outer end of the spacer 92. The diameter of the nut 94 is less than the width of the recess 90, but significantly greater than the diameter of the stud 82, the spacer 92 and the minimum width of the vertical slot 88.

The above described mid coupling 64 permits movement of the mid section of the sponson body 52 through a generally arcuate path as the fore end 56 of the sponson body 52 is rotated about the longitudinal axis of the stud 68. The mid coupling also holds the middle portion of the sponson body 52 in close proximity to the lower hull section 16 to minimize any free-play motion between the sponson 12 and the hull 14.

Although not illustrated, the mid coupling 64 also can include a releasably locking mechanism which positively fixes the position of the sponson body 52 relative to the stud 82. Such a locking mechanism desirably includes a quick release device and can be operated by hand.

With reference to FIGS. 3, 6, 7 and 8, the aft coupling 66 includes a guide mechanism which defines a travel path for the movement of the aft end 54 of the sponson body 52 as the fore end 56 is rotated about the front coupling 62. A drive mechanism is provided to move the aft end 54 of the sponson body 52 along the travel path. And a locking mechanism selectively inhibits movement of the aft end 54 of sponson body 52 along the travel path. In the illustrated embodiment, the guide mechanism, drive mechanism and locking mechanism are integrated into a single device to form the aft coupling 66; however, it is understood that each of these mechanisms can operate between the hull 14 and the sponson body 52 independent of each other. The individual components of the guide mechanism, drive mechanism and locking mechanism will now be described in detail.

The aft coupling 66 includes a mounting bracket 96 that is affixed to the side 48 of the lower hull section 16 above the outer chines 50 by a pair of bolts 98. The bolts 98 extend into the bilge area of the lower hull section 16 through corresponding openings formed in the mounting bracket 96 and in the side 48 of the lower hull section 16. The bolts 98 also extend through openings formed in a mounting plate 99 which is positioned inside the lower hull 16 adjacent to the side wall 48. While the mounting plate 99 is described as a separate mounting plate, it is understood that the mounting plate 72 may also be used in association with the aft coupling 66.

A nut 100, positioned within the hull lower section 16, threadingly engages each bolt 98 and impinges against the mounting plate 99. The corresponding nuts 100 and bolts 98 force the mounting bracket 96 and mounting plate 99 against the side 48 of the lower hull 16. In this manner, the mounting bracket 96 is rigidly attached to the lower hull section 16.

The mounting bracket 96 is formed with outwardly extending arms 102 at its upper and lower ends. The arms 102 support a tracking screw assembly 104. For this purpose, the arms 102 have openings which receive portions of a tracking screw assembly 104 in a manner that permits the rotation of the tracking screw assembly 104 within the arms 102 about its own longitudinal axis.

In the illustrated embodiment, the upper arm 102 includes an elongated generally U-shaped slot 105 which extends into the upper arm 102 from its rear side. The rear side of the slot 105 thus is open and receives a portion of the tracking screw assembly 104, as described below. The width of the slot 105 can vary along its length to receive the portion of the screw assembly 104 in a snap fit manner. The lower arm 102 includes a hole 107 which is positioned beneath the slot 105. The hole 107 also is sized to receive a portion of the tracking screw assembly 104.

Figure 7:
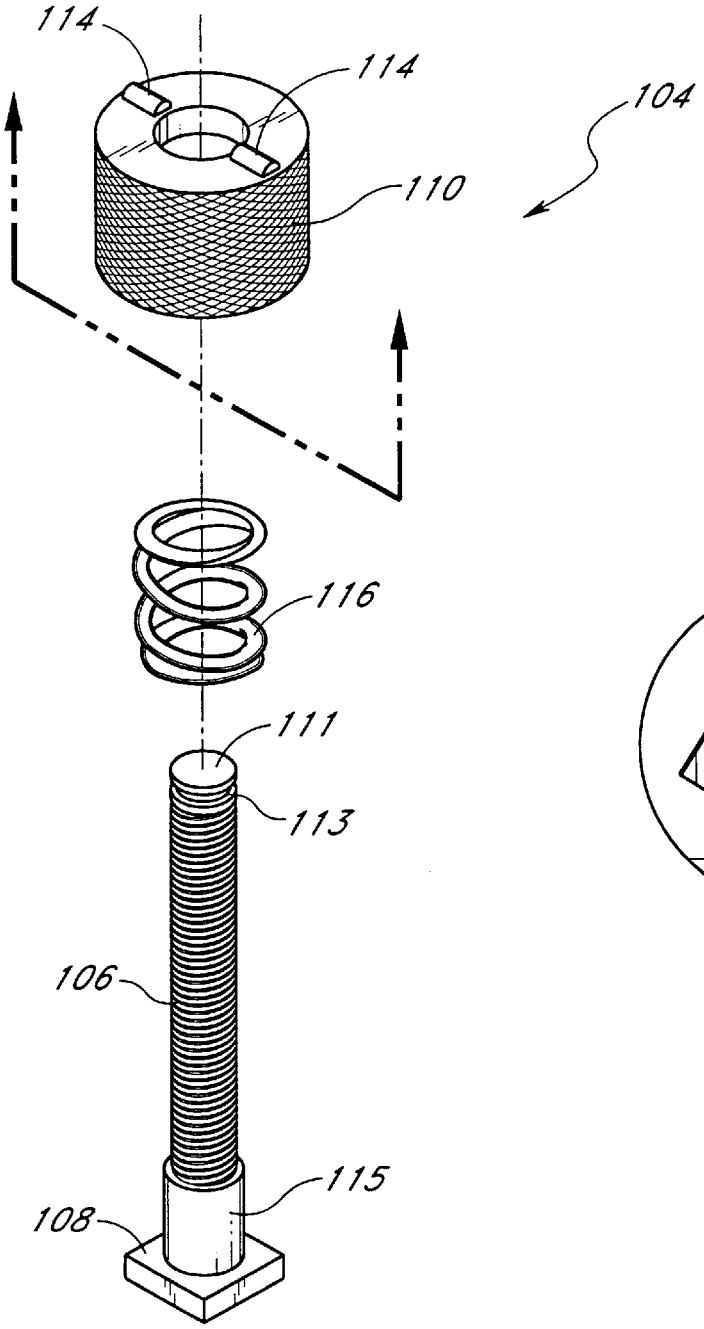
FIG. 7 is an exploded perspective view of a screw and handle assembly of the rear coupling mechanism of FIG. 4*a*.
Figure 8:
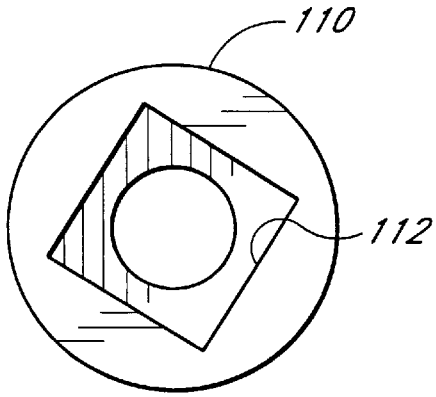
FIG. 8 is a bottom plan view of a portion of the handle of FIG. 7.

With reference to FIGS. 7 and 8, the tracking screw assembly 104 includes a threaded screw 106 with a square-shaped head 108. The screw 106 extends through a knob 110 which, as seen in FIG. 8, has a square-shaped recess 112 formed on one side to receive the head 108 of the screw 106. In this manner the screw 106 and the knob 110 are coupled together such that rotation of the knob 110 rotates the screw 106.

The screw 106 includes an unthreaded end 111 which is circumscribed by an annular groove 113. The screw 106 also includes a shoulder 115 positioned between its threaded shank and its head 108.

In the illustrated embodiment, the shoulder 115 of the screw 106 slips through the opening 107 of the lower arm 102. The diameter of the shoulder 115 desirably is slightly smaller than the diameter of the opening. The rearward facing opening of the upper arm slot 105 receives the screw end 111 in a snap-fit fashion, with the portions of the arm 102 on the sides of the slot 105 fitting into the annular groove 1113 on the screw 106. In this manner, as seen in FIG. 6*a*, the mounting bracket 96 secures the threaded track assembly 104 to the hull wall 48, while permitting the screw 106 to rotate about its longitudinal axis.

A plurality of detents 114 are disposed on the upper surface of the knob 110 and engage recesses 117 formed in the lower surface of the lower arm 102 of the mounting bracket 96 when the tracking screw assembly 104 is assembled. A biasing member 116 urges the detents 114 into engagement with the corresponding recesses 117. In the illustrated embodiment, the biasing member 116 comprises a helical compression spring. The spring 116 is positioned over the shoulder 115 of the screw 106 within the recess 112 of the knob 110. In this position, the spring 116 lies between the screw head 108 and an inner surface of the knob recess 112 to bias the knob 1 10 toward the lower arm 102 of the mounting bracket 96.

In the illustrated embodiment, the detents 114, corresponding recesses 117 and biasing member 116 form the locking mechanism. When the above tracking screw assembly 104 is snap-fitted within the arms 102 of the mounting bracket 96, the screw 106 is not permitted to rotate about its own longitudinal axis, because the knob 110 is forced against the lower arm 102 of the mounting bracket 96 to engage the detents 114 and the corresponding recesses 117. The screw 106, which forms part of the guide and drive mechanisms, as described below, is prevented from rotating.

Figure 6A:
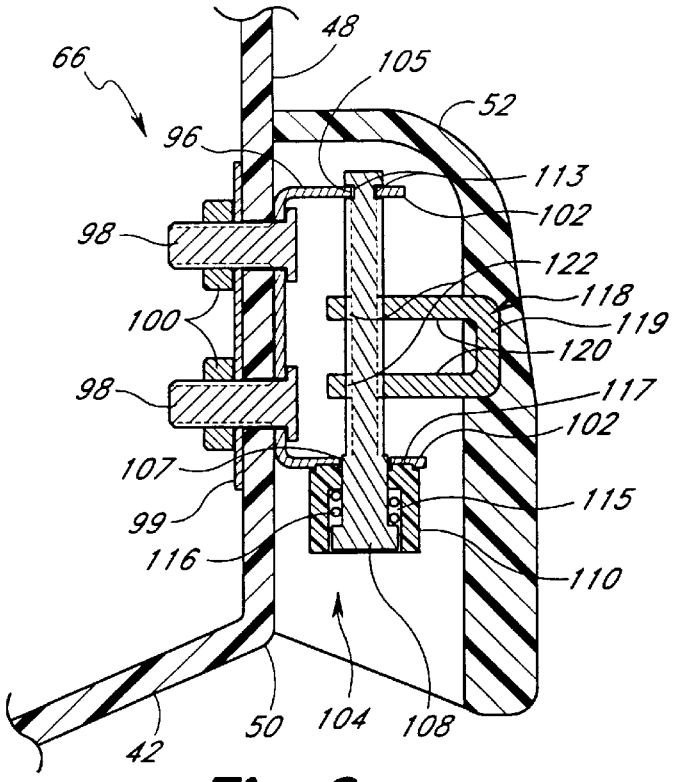
FIGS. 6*a* and 6*b* are cross-sectional views of a rear coupling mechanism of the sponson taken along line 6—6 of FIG. 3.
Figure 6B:
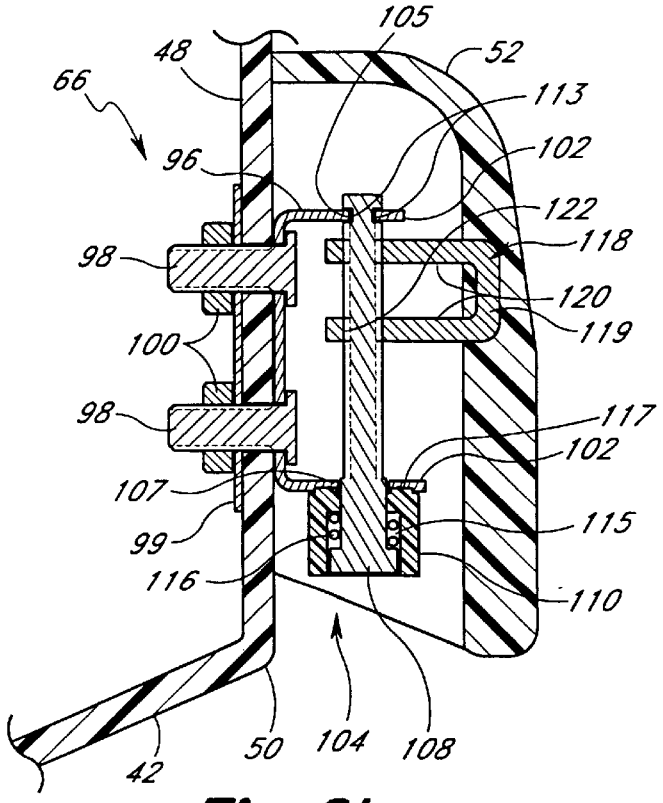

As seen in FIGS. 6*a* and 6*b*, a tracking bracket 118 is additionally disposed in relationship with the tracking screw assembly 104. The tracking bracket 118 is generally U-shaped, with its arm portions 120 extending inwardly between the upper and lower arms 102 of the mounting bracket 96. Openings 122 are formed in the arms 120 through which the threaded portion of the screw 106 extends. The lower opening 122 is threaded and threadingly engages the threaded portion of the screw 106. The upper opening is unthreaded and rides over the threads of the screw 106.

It is to be noted that a small amount of play (i.e., looseness) exists between the upper and lower openings of the tracking bracket 118 and the screw 106. This permits the tracking bracket 118 to swing through a minimal arc (e.g, 3–5°) about the pivot stud 68 with a pivot radius of approximately 440 mm, while being driven linearly by the screw 106 along a portion of the screw's length in a generally vertical direction. The travel path of the tracking bracket 118 is limited at least in part by the length between the arms 102 of the mounting bracket 98. In the illustrated embodiment, the defined path length is about 25.4 mm. The variation between the straight and arced paths for this path length falls within the thread clearance, or slack, between the threaded portion of the screw 106 and the tracking bracket lower arm threaded opening 122 which permits the tracking bracket 118 to follow the arced path dictated by the pivoting mechanism 62.

It should be noted that while the above tracking system allows the sponson 52 to rotate through an arc of 3–5° the range of rotation may be altered by changing the pivot radius path length or the distance between the arms 102 of the bracket 96. By so doing the arc of rotation may easily be increased into the 10–20° range if desired.

A base 119 of the tracking bracket 118 is rigidly attached to the aft end 54 of the sponson body 52. In the illustrated embodiment, the base 119 of the tracking bracket 118 is embedded into the reinforced resin sponson body during manufacture.

In the illustrated embodiment, the cooperation between the tracking bracket 118 and the screw 106 form the guide mechanism. The screw 106 defines the vertical travel path along which the tracking bracket 118 moves. The interconnection between the tracking bracket 118 and the screw 106 also forms the drive mechanism. As the screw 106 is rotated in one direction, the tracking bracket 118 moves along the length of the screw. Rotation of the screw 106 in one direction moves the tracking bracket 118 in one direction along the screw's length, and rotation in the opposite rotational direction moves the tracking bracket 118 in the opposite direction along the screw's length. The locking mechanism, formed by the cooperating detents 114 and recesses 117, prevents rotation of the screw 106, and hence movement of the tracking bracket 118 along the screw's length. Thus, the above defined aft coupling mechanism 66 defines locking, driving and guiding mechanisms which are disposed within a volume of space bounded by the side wall 48 of the hull 14 and the walls of the sponson body 52.

As understood from FIGS. 6*a* and 6*b*, the entire aft coupling 66 is contained within a space defined between the hull side wall 48, the top of the sponson body 52 and the outer side of the sponson body 52. This is true throughout the range of travel, from the fully lowered position shown in FIG. 6*a* to the fully raised position shown in FIG. 6*b*. As such, the coupling 66 remains protected within the sponson body 52 and does not pose a hazard by protruding outwardly from the sponson body 52 in a direction away from the watercraft hull 16.

The following elaborates on the previous description of the operation of the aft coupling 66. With reference to FIG. 6*a*, the tracking bracket 118 lies proximate to the lower arm 102 of the mounting bracket 96 and the sponson 12 is disposed in a generally downwardly rotated position. Pulling the knob 110 of the tracking screw assembly 104 away from the mounting bracket arm 102, removes the detents 114 from the corresponding recesses 117 in the arm 102 and allows rotation of the tracking screw assembly 104. In other words, pulling down on the knob 110 unlocks the drive mechanism.

As understood from FIG. 6*a*, the knob 110 is readily accessible though it is located within the region of space bounded by the side wall 48 and the sponson body 52. Even when the sponson 12 is in its lowest position, the knob 110 is accessible. The drive mechanism thus can be unlocked and operated regardless of the angular orientation of the sponson body 52.

In the illustrated embodiment, counter-clockwise rotation of the tracking screw assembly 104 impinges the upward-facing thread side of the threaded portion of the screw 106 against the downward-facing thread side of the threaded edges of the openings 122 of the tracking bracket arms 120. This forces the tracking bracket 118, and thus the rearward end 54 of the sponson body 52, upwards, as is shown in FIG. 6*b*, and causes the sponson body 52 to pivot about the longitudinal axis of the pivot stud 68. In like manner, rotating the tracking screw assembly 104 clockwise causes the threaded portion of the screw 106 to displace the tracking bracket 118, and thus the rearward end 54 of the sponson body 52, downward.

In this manner, as schematically illustrated in FIG. 3, the coupling mechanism of the illustrated embodiment allows the aft end 54 of the sponson body 52 to be raised and lowered relative to the fore end 56. The sponson body 52 thus can be pivoted about a point proximate to its fore end 56 to change the angular orientation of the sponson body 52 on the watercraft 10, and to vary the attack angle of the sponson 12, i.e., the angle of the sponson 12 relative to the surface of the body of water in which the watercraft 10 is being operated.

The present coupling mechanism can be operated by the rider of the watercraft 10 without the use of tools and allows for adjustment of the angular orientation of the sponson 12 about the longitudinal axis of the stud 68 and relative to the outer chines 50 of the hull lower section 16. This ability to adjust the angular orientation of the sponson bodies 52 allows the rider to tailor the handling characteristics of the watercraft 10 to suit riding conditions and to optimize speed, responsiveness, and ride comfort.

The angle of the sponson 12 relative to the outer chine 50 affects the stability and handling characteristics of the watercraft 10. A pronounced positive angle (i.e., the fore end 56 positioned above the aft end 54) helps maintain the bow of the personal watercraft 10 just above the water's surface when planing. This effect consequently inhibits "porpoising" of the bow to maximize boat speed. Too large of an angle, however, can tend to force the bow down too far and substantially dig into wakes and chops in the water, producing an unpleasant ride. The optimum angle varies depending upon the rider's size (i.e., the loading on the personal watercraft 10) and the water conditions. This will also give the personal watercraft 10 more aggressive turning characteristics and responsiveness.

As seen in FIG. 3, the angle of incidence (i.e., attack angle) for the sponson 12 may be infinitely varied between a maximum upper angle that is defined by the line U and measured relative to an incident line I, and a maximum lower angle that is defined by the line L and also measured relative to the incident line I. The incident line I extends longitudinally along the lower hull section 16 parallel to the rearward portion of the upper chine 50 and intersects the longitudinal axis of the pivot 68 and the guide mechanism stud 82. If the sponson 12 is oriented well below the incident line I, a substantial portion of the sponson 12 will cut into the water with minimum lean by the rider. The watercraft 10 tends to pivot about or ride on the relatively short sponson 12, with the sponson 12 respectively acting as an additional outer chine channeling the water. The lower the sponson 12 is rotated in relation to the outer chine 50, the tighter the watercraft will turn and the more aggressive the handling characteristics of the watercraft 10 will become.

Some riders prefer a slightly negative angular orientation of the sponsons 12, i.e., the aft end 54 positioned above the fore end 56. The slight negative angle of the sponsons 12 keeps the bow of the watercraft 10 up when the watercraft 10 is on plane.

This provides a more stable and comfortable ride, without sacrificing speed, and lessens the tendency of the watercraft 10 to dig into the water at high speeds. At planing speeds, the lower surface 58 of the sponsons 12 normally rides above the level of the water when traveling straight. The size of the hull 16 in the water is reduced, thereby reducing drag on the personal watercraft 10 and improving top speed. When the rider turns the personal watercraft 10 at elevated speeds, the rider must lean the watercraft 10 on its side before the sponson 12 contacts and cuts (i.e., hooks) into the water. The hull 14 leans or keels over, and the sponson 12, on the side of the direction of turn, contacts the water. The lower surface 58 of the sponson 12 effectively widens the hull 14 (i.e., creates a greater hull surface) to give the personal watercraft 10 greater stability and to counteract the rider's shifted body weight when turning. As a result, the sponson 12 affords additional stability as the watercraft 10 leans to one side during turns. Of course, the degree to which changes in the angular orientation of the sponson 12 affect the stability and handling characteristics of the watercraft 10 will vary with the size and shape of the watercraft 10.

The ability to change the angular orientation of the sponsons 12 thus allows each rider to change the riding characteristics of the watercraft 10. The positive angular orientation of the sponson 12 can easily be adjusted to improve the ride of the watercraft 10 for the particular size of the rider. The sponsons 12 also can readily be set in a slightly negative angular orientation to improve top-end performance of the watercraft 10 when up on a plane.

FIGS. 9–13 illustrate an adjustable sponson configured in accordance with another embodiment of the present invention. The adjustable sponson is similar in many respects to the adjustable sponson described above. The differences mainly reside in the configuration of the aft coupling. The aft coupling of this embodiment omits a locking mechanism, and the operator handle of the drive mechanism extends above the sponson. Also, because the aft coupling mechanism extends upwardly above the sponson, the lower side of the sponson body is fully closed. Because many of the components of the adjustable sponson of this embodiment are the same or are substantially similar to those of FIGS. 1–6, like reference numerals with an "a" suffix will be used to indicate like components.

Figure 9:
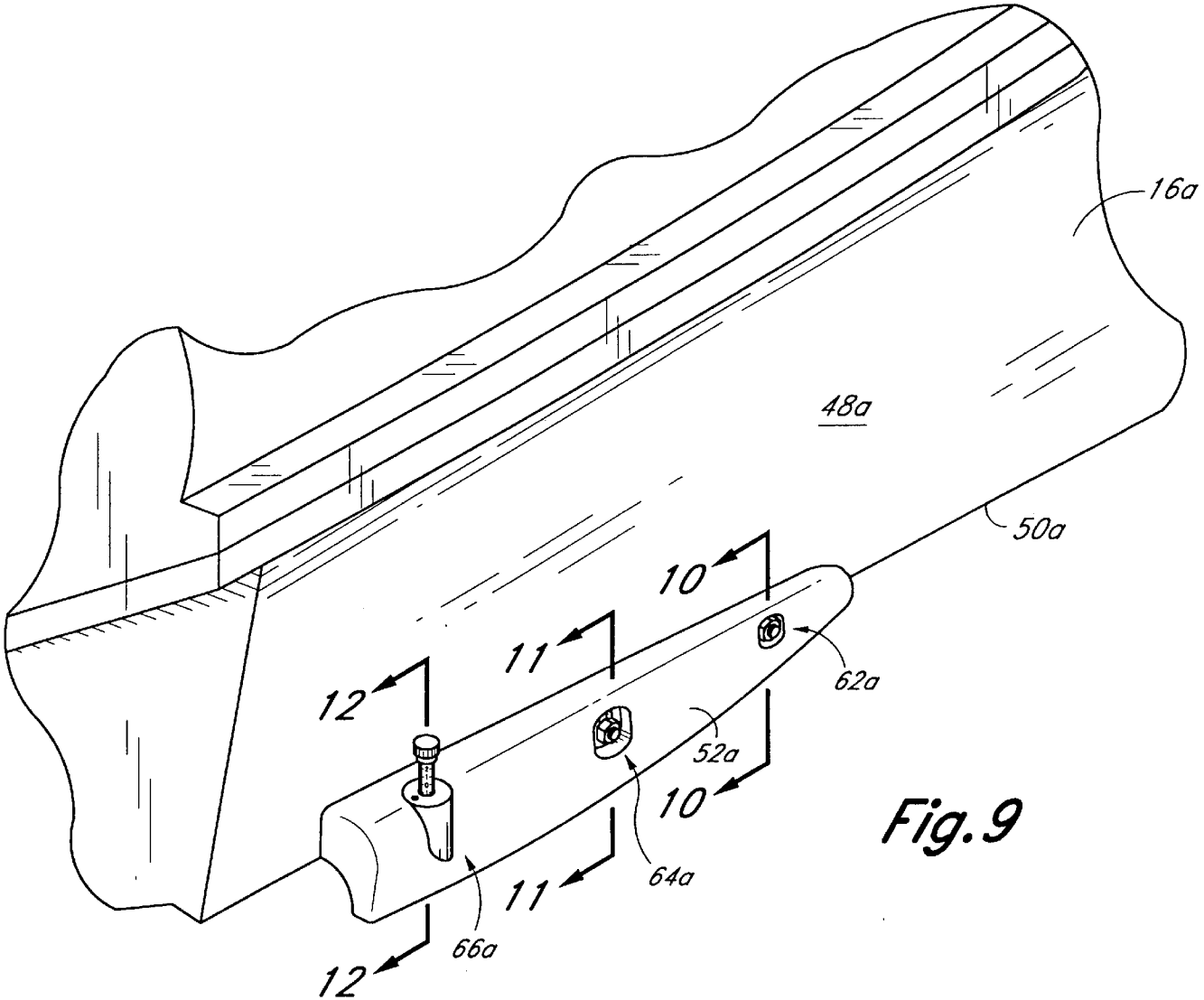
FIG. 9 is a perspective view of an adjustable sponson configured in accordance with a preferred embodiment of the present invention, attached to a side of a personal watercraft.

With reference to FIG. 9, the coupling mechanism couples the sponson body 52*a* to the lower hull section 16*a*. The coupling mechanism also allows for adjustment of the angular orientation of the sponson body 52*a* relative to the corresponding outer chine 50*a* of the hull lower section 16*a*, as described below. The coupling mechanism includes a front coupling 62*a*, a mid coupling 64*a*, and an aft coupling 66*a*, which allow the sponson body 52*a* to move relative to the watercraft hull side 48*a* in order to adjust the angular orientation of the sponson body 52*a*.

Figure 10:
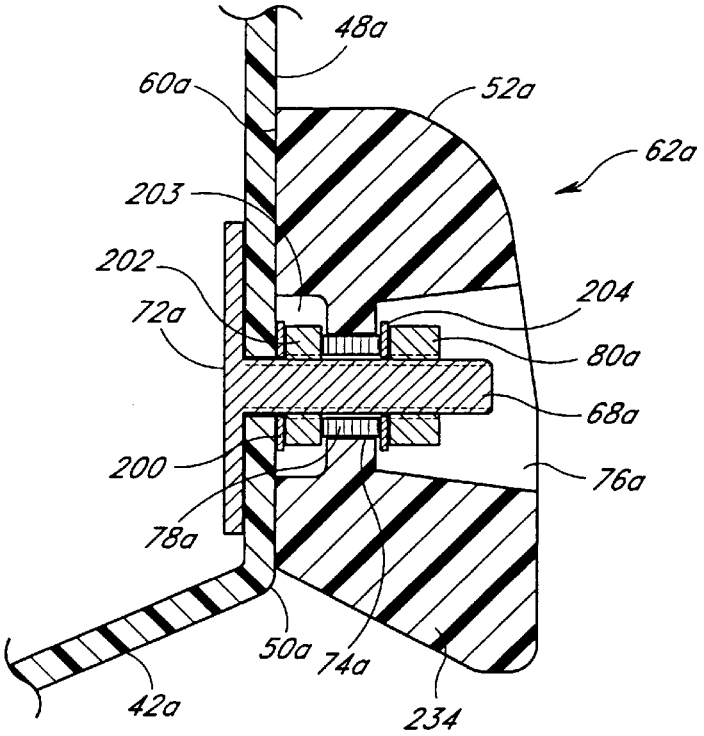
FIG. 10 is a cross-sectional view of a front coupling mechanism of the sponson taken along line 10—10 of FIG. 9.

As seen in FIG. 10, the front coupling 62*a* includes a threaded stud 68*a* that is integrally formed with the mounting plate 72*a*. The stud 68*a* extends outwardly through an aperture formed in the side wall 48*a* of the hull lower section 16*a*. The mounting plate 72*a* lies inside the hull 16*a* adjacent to the side wall 48*a* to reinforce the side wall 48*a* at this location. The diameter of the opening formed in the side wall 48*a* generally equals the size of the diameter of the stud 68*a* extending through the side wall 48*a*. The tight fit between the stud 68*a* and the side wall aperture inhibits water flow into the hull 16*a* through the aperture. Although not illustrated, an O-ring or a similar seal may be placed about or in the aperture of the side wall 48*a* to improve the seal with the mounting plate 72*a* and the stud 68*a*.

A washer 200 is placed about the stud 68*a* and is pressed against the outer surface of the lower hull 16*a* by a mounting plate lock nut 202. The washer 200 improves the seal between the stud 68*a* and the side wall 48*a*. The lock nut 202 threadingly engages the stud 68*a* and maintains contact between the mounting plate 72*a* and the inside of the lower hull 16*a*.

In the illustrated embodiment, the washer 200 and lock nut 202 are disposed within a front inner cavity 203 of the sponson body 52*a*. The inner cavity 203 extends into the sponson body 52*a* from the generally flat inner mounting surface 60*a* of the sponson body 52*a*. The cavity 203 has a sufficient size to fit easily over the washer 200 and the lock nut 202 when the mounting surface 60*a* abuts the hull side 48*a*.

The outer end of the stud 68*a* extends through a hole 74*a* within the sponson body 52*a*. The hole 74*a* extends between the cavity 203 and a counterbore recess 76*a*. The recess 76*a* extends into the sponson body 52*a* from the outer side of the sponson body 52*a* opposite of the cavity 203.

A spacer 78*a* is inserted in the hole 74*a* over the stud 68*a*. The spacer 78*a* provides a bearing surface about which the fore end 56*a* of the sponson body 52*a* can rotate. The inner end of the spacer 78*a* abuts the locking nut 202, while its outer end extends slightly beyond the inner surface of the recess 76*a*. A nut 80*a* is disposed within the recess 76*a* and is threaded onto the outer end of the stud 68*a*. The inner side of the locking nut 80*a* presses against a washer 204 that is inserted over the studs 68*a* between the outer end of the spacer 78*a* and the nut 80*a*. The diameter of the washer 204 is less than the diameter of the recess 76*a*, but greater than the diameter of the pivot stud 68*a* and the opening 74*a*. The front coupling mechanism 62*a* allows the sponson 12*a* may be rotated about the longitudinal axis of the stud 68*a*, while its generally flat, inner mounting surface 60*a* slides over the side wall 48*a* of the lower hull section 16*a*. The nut 80*a* and washer 204 also hold the fore end of the sponson body 52*a* against the side wall 48*a*.

Figure 11:
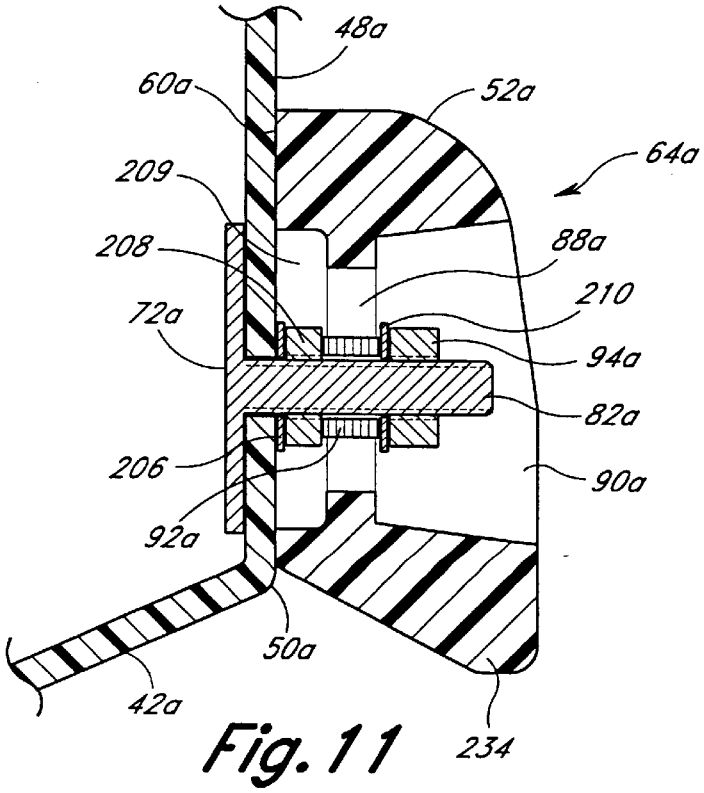
FIG. 11 is a cross-sectional view of a mid coupling mechanism of the sponson taken along line 11—11 of FIG. 9.

With reference to FIG. 11, the mid coupling 64*a* of the illustrated embodiment includes a threaded stud 82*a* that is integrally formed with the mounting plate 72*a*. The stud 82*a* extends outwardly through an aperture formed in the side wall 48*a* of the lower hull section 16*a*. While the above mounting plate 72*a* is described as a single mounting plate, it is understood that a dedicated mounting plate may be used with each of the fore and mid couplings 62*a* and 64*a*.

The diameter of the opening formed in the side wall 48*a* desirably is generally equal in size to the diameter of the portion of the stud 82*a* extending through the side wall 48*a*. The tight fit between the stud 82*a* and the side wall aperture inhibits water flow into the hull 16*a* through the aperture. Although not illustrated, an O-ring or similar seal can be placed about or in the aperture of the side wall 48*a* to improve the seal with the mounting plate 72*a* and the stud 82*a*.

A washer 206 is placed about the stud 82*a* and is pressed against the outer surface of the lower hull 16*a* by a mounting plate lock nut 208. The washer 206 improves the seal between the stud 82*a* and side wall 48*a*. The lock nut 208 threadingly engages the stud 82*a* and maintains contact between the rear of the mounting plate 72*a* and the inside of the lower hull 16*a*.

In the illustrated embodiment, the washer 206 and lock nut 208 are disposed within a mid inner cavity 209 of the sponson body 52*a*. The cavity 209 extends into the sponson body 52*a* from the generally flat inner mounting surface 60*a* of the sponson body 52*a*. The cavity 209 has a sufficient size to fit easily over the washer 206 and the lock nut 208 when the mounting surface 60*a* abuts the hull side 48*a*.

The stud 82*a* also extends through a slot 88*a* formed in the middle portion of the sponson body 52*a*. In the illustrated embodiment, the slot 88*a* generally has an elongated, straight shape and lies with its longitudinal axis positioned generally normal to the longitudinal axis of the sponson body 52*a*. However, it is appreciated that other shapes (e.g., arcuate) and other orientations of the slot 88*a* also can be used in order to suit a particular application.

As seen in FIG. 11, the slot 88*a* extends between the cavity 209 and an inner surface of a recess 90*a*. The recess 90*a* extends into the sponson body 52*a* from the outer side directly opposite the slot 88*a*.

The width of the slot 88*a* is larger than the diameter of the stud 82*a* to permit the sponson body 52*a* to pivot about the longitudinal axis of the pivot shaft 68*a*. In the illustrated embodiment, the length of the slot 88*a* is approximately 4–5 times larger than the diameter of the stud 82*a*. This allows the vertical position of the center portion of the sponson body 52*a* to move up or down relative to the stud 82*a*.

A spacer 92*a* is disposed within the vertical slot 88*a* over the stud 82*a*. The spacer 92*a* provides a bearing surface over which the mid section of the sponson body 52*a* can slide. The inner end of the spacer 92*a* abuts the locking nut 208, while its outer end extends slightly beyond the inner surface of the recess 90*a*. A nut 94*a* is disposed within the recess 90*a* and threadingly engages the outer end of the stud 82*a*. The inner side of the nut 94*a* presses against a washer 210 that is placed on the stud 82*a* between the outer end of the spacer 92*a* and the nut 94*a*. The diameter of the washer 210 is less than the width of the recess 98, and greater than the diameters of the stud 82*a* and the spacer 92*a*. The outer diameter of the washer 210 also is greater than the minimum width of the vertical slot 88*a*.

The above-described mid coupling 64*a* permits movement of the mid section of the sponson body 52*a* through a generally arcuate path as the fore end 56*a* of the sponson body 52*a* is rotated about the longitudinal axis of the stud 68*a*. The mid coupling 64*a* also holds the middle portion of the sponson body 52*a* in close proximity to the lower hull section 16*a* to reduce any free-play motion between the sponson 12*a* and the lower hull 16*a*.

Figure 12A:
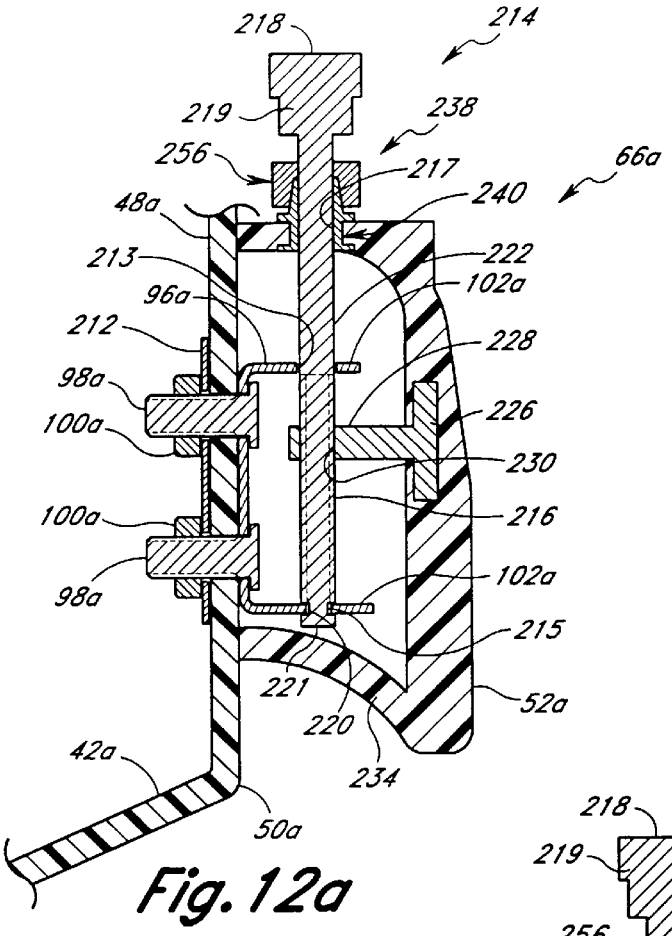
FIGS. 12*a* and 12*b* are cross-sectional views of a rear coupling mechanism of the sponson taken along line 12—12 of FIG. 9.
Figure 12B:
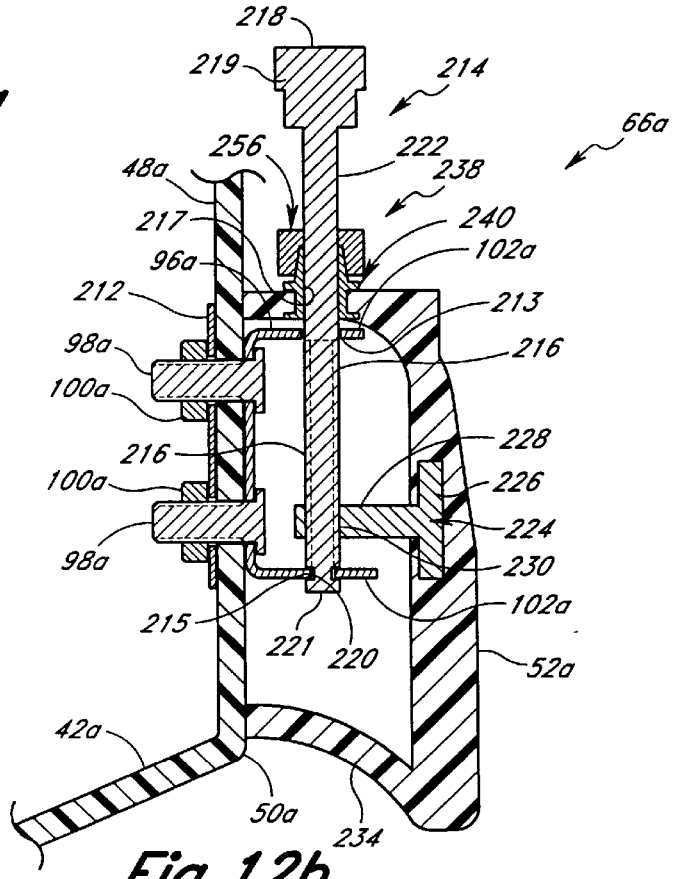

With reference to FIGS. 12*a* and 12*b*, the aft coupling 66*a* includes a guide mechanism which defines a travel path for the movement of the aft end 54*a* of the sponson body 52*a* as the fore end 56*a* is rotated about the front coupling 62*a*. A drive mechanism is provided to move the aft end 54*a* of the sponson body 52*a* along the travel path. In the illustrated embodiment, the guide mechanism and drive mechanism are integrated into a single device to form the aft coupling 66*a*. However, it is understood that each of these mechanisms can operate between the hull 14 and the sponson body 52*a* independent of each other. The individual components of the guide and drive mechanisms will now be described in detail.

The aft coupling 66*a* includes amounting bracket 96*a* that is affixed to the side wall 48*a* of the lower hull section 16*a* above the outer chine 50*a* by a pair of bolts 98*a*. The bolts 98*a* extend into the bilge area of the lower hull section 16*a* through corresponding openings formed in the mounting bracket 96*a* and in the side 48*a* of the lower hull section 16*a*. The bolts 98*a* alternatively can be formed integrally with the mounting plate 212.

The bolts 98*a* also extend through openings formed in a mounting plate 212 which is held against the inner side of the wall 48*a* by lock nuts 100*a*. While the above mounting plate 212 is described as separate from the mounting plate 72*a* used with the fore and mid couplings 62*a*, 64*a*, a single mounting plate can be used with all three couplings 62*a*, 64*a*, 66*a*. The lock nuts 100*a* are positioned within the hull lower section 16*a* and threadingly engage the corresponding bolt 98*a*. The nuts 100*a* and bolts 98*a* hold the mounting bracket 96*a* and the mounting plate 212 against opposite sides of the hull side 48*a*. In this manner the mounting bracket 96*a* is rigidly attached to the lower hull section 16*a*.

The mounting bracket 96*a* is formed with outwardly extending arms 102*a* at its upper and lower ends. The arms 102*a* support *a* tracking screw assembly 214. For this purpose the arms have openings which receive portions of the tracking screw assembly 214 in a manner that permits the rotation of the tracking screw assembly 214 within the arms 102*a* about its own longitudinal axis.

In the illustrated embodiment, the upper arm 102*a* of the mounting bracket 96*a* includes a hole 213 which is sized to receive a portion of the tracking screw assembly 214. The lower arm 102*a* includes an elongated generally U-shaped slot 215 which extends into the upper arm 102*a* from its rear side. The rear side of the slot 215 thus is open and receives a portion of the tracking screw assembly 214, as described below. The width of the slot 215 also can vary along its length to receive the portion of the tracking screw assembly 214 in a snap fit manner.

The tracking screw assembly 214 includes a threaded screw 216, which extends upwardly through an aperture 217 in the sponson body 52*a*, and a handle 218 which includes a knob 219 that is affixed to its upper end. The screw 216 includes an unthreaded end 221 with an annular groove 220. The groove 220 is sized to cooperate with the rearwardly-facing slot 215 in the lower arm 102*a* of the mounting bracket 96*a*. The screw 216 also includes a shoulder portion 222 positioned between the thread and the knob 219.

In the illustrated embodiment, the rearward-facing slot 215 of the lower arm 102*a* receives the screw end 221 in a snap-fit fashion with a portion of the arm 102*a* about the slot 215 fitting into the groove 220 on screw 216. The shoulder 222 of the screw 216 slips through the opening 213 of the upper arm 102*a*. The diameter of the shoulder 222 desirably is slightly smaller than the diameter of the opening 213. In this manner, as seen in FIGS. 12*a* and 12*b*, the mounting bracket 96*a* secures the threaded track assembly 214 to the hull side wall 48*a* while permitting the screw 216 to rotate about its longitudinal axis.

A tracking bracket 224 cooperates with the tracking screw assembly 214. The tracking bracket 224 has a generally T-shape formed by a vertical stabilizer leg 226 and a horizontally projecting lug 228. The lug 228 extends between the upper and lower arms 102*a* of the mounting bracket 96*a*. An opening 230 through the lug 228 receives the threaded portion of the screw 216. The opening 230 is threaded and engages the threaded portion of the screw 216.

It is to be noted that a small amount of play, i.e., looseness, exists between the opening 230 of the tracking bracket 224 and the screw 216. This permits the tracking bracket 224 to swing through a minimal arc, e.g., 35° about the pivot stud 68*a*, with a pivot radius being about 440 mm, while being driven linearly by the screw 216 along the length of the screw. The travel path of the tracking bracket 224 is limited at least in part by the length between the arms 102*a* of the mounting bracket 96*a*. In the illustrated embodiment, the defined path length is about 25.4 mm. The variation between the straight and arc paths over the path length falls within the thread clearance or slack between the threaded portion of the screw 216 and the tracking bracket threaded opening 230, which permits the tracking bracket 224 to follow the arced path dictated by the pivoting mechanism 62*a*.

It should be noted that while the above tracking system allows the sponson 52*a* to rotate through an arc of 3–5° the range of rotation may be altered by changing the pivot radius path length or the distance between the arms 102*a* of the bracket 96*a*. By so doing the arc of rotation may easily be increased into the 10–20° range if desired.

The stabilizer leg 226 of the tracking bracket 224 extends inwardly and is secured to the side wall of the aft end 54*a* of the sponson body 52*a*. In the illustrated embodiment, the let 226 of the tracking bracket 224 is embedded into the reinforced resin sponson body 52*a* during manufacture.

Figure 13:
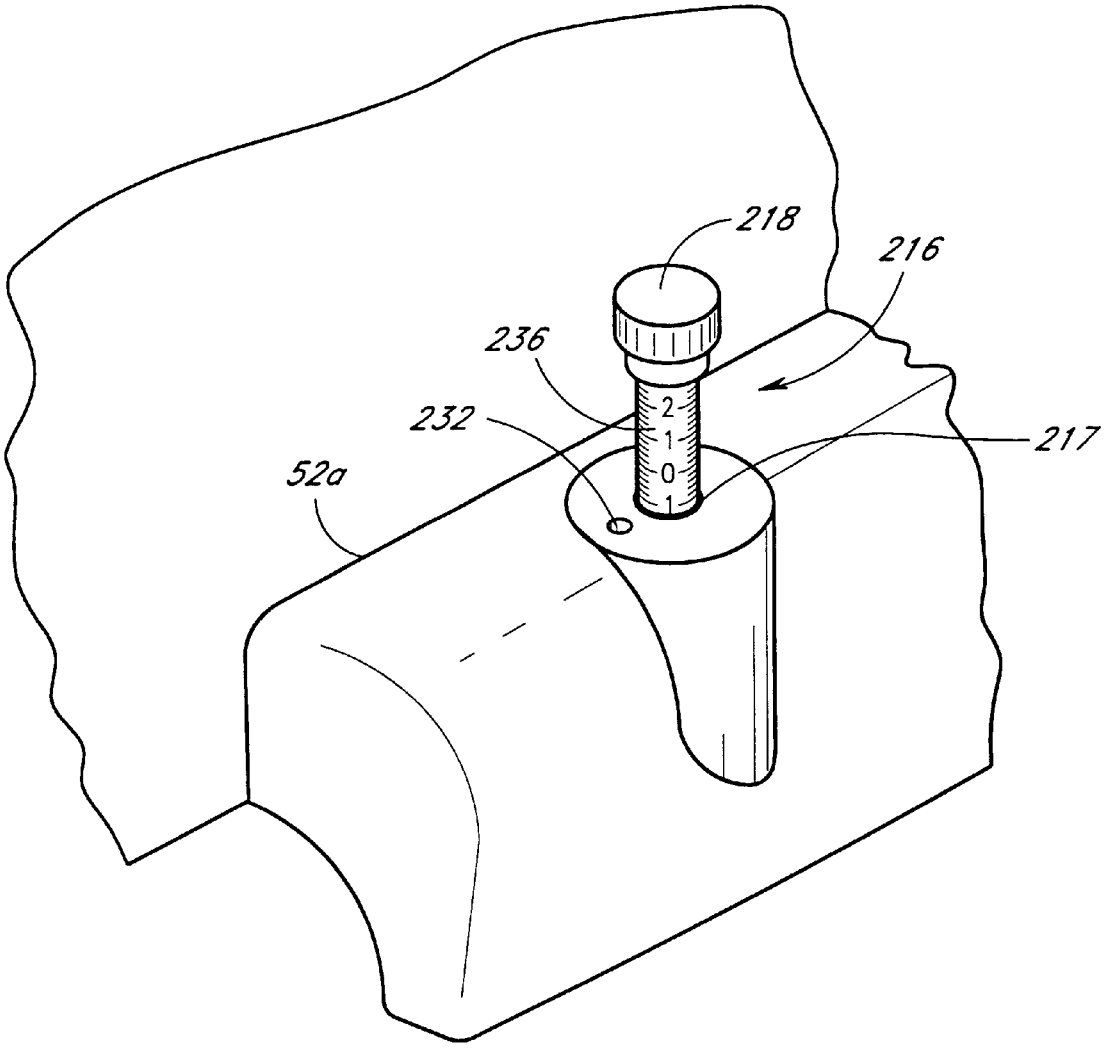
FIG. 13 is an enlarged perspective view of an aft end of the adjustable sponson of FIG. 9.

As seen in FIG. 13, a hole 232 extends through the upper aft end 54*a* of the sponson body 52*a* in close proximity to the coupling mechanism 66*a*. The hole 232 serves as the means by which lubricating oil may be supplied to the coupling mechanism 66*a*. The hole 232 desirably lies just to the side of the screw 216 and opens into the cavity within the sponson body 52*a* at a position above the upper arm 102*a* of the mounting bracket 102*a* and near the hole 213 through which the screw 216 passes. At this position, a lubricant can drip from the hole 232 and onto the arm 102*a*, and flow over the threads of the screw 216.

As seen in FIGS. 12*a* and 12*b*, the aft coupling 66*a* principally lies within a cavity formed between the sponson body 52*a* and the hull side wall 48*a*. Only the operator knob 218 extends above the sponson body 52*a*. A lower portion 234 of the sponson body 52*a* encloses the aft coupling 66*a* within this space. The drive and guide mechanisms of the aft coupling 66*a* thus remain protected within the sponson body 52*a*, regardless of the position (e.g., fully raised or fully lowered) of the aft end 54*a* of the sponson 12*a*. The coupling mechanism also does not protrude outwardly from the sponson body 52*a* in a direction away from the watercraft hull 16*a*.

In the illustrated embodiment, the cooperation between the tracking bracket 224 and the screw 216 forms the guide mechanism. The screw 216 defines the travel path along which the tracking bracket 224 moves. The interconnection between the tracking bracket 224 and the screw 216 also forms the drive mechanism. As the screw 216 is rotated in one direction, the tracking bracket 224 moves along the length of the screw 216. Rotation of the screw 216 in one direction moves the tracking bracket 224 in one direction along the screw's length, and rotation in the opposite rotational direction moves the tracking bracket 224 in the opposite direction along the screw's length.

In the illustrated embodiment, counterclockwise rotation of the tracking screw assembly 214 impinges the upwardly facing thread side of the threaded portions of the screw 216 against the downwardly facing thread side of the threaded edge of the opening 230 of the tracking bracket 224. This forces the tracking bracket 224, and thus the rearward end 54*a* of the sponson body 52*a*, upwards to the fully raised position illustrated in FIG. 12*a*, and causes the sponson body 52*a* to pivot about the longitudinal axis of the pivot stud 68*a*. In like manner, rotating the tracking screw assembly 214 clockwise causes the threaded portion of the screw 216 to force the tracking bracket 224, and thus the rearward end 54*a* of the sponson body 52*a* downward to the fully lowered position illustrated in FIG. 12*b*.

As best seen in FIG. 13, the shoulder portion 222 of the screw 216 desirably includes indicia 236 to indicate the position of the aft end 54*a* relative to a horizontal. In the illustrated embodiment, the shoulder portion 222 includes markings 236. The marking 236 serve as a means by which the angular orientation of the sponson body 52*a* relative to the lower hull 16*a* of the watercraft 10 can be determined.

The coupling mechanism of the illustrated embodiment allows the aft end 54*a* of the sponson body 52*a* to be raised and lowered relative to the fore end 56*a* in a precisely measured and controlled manner. The sponson body 52*a* thus can be pivoted about a point proximate to its fore end 56*a* to change the angular orientation of the sponson body 52*a* on the watercraft 10 and to vary the attack angle of the sponson 12*a*, i.e., the angle of the sponson 12*a* relative to the surface of the body of water in which the watercraft 10 is being operated.

Although friction within the aft coupling 66*a* will generally maintain the established position of the sponson body 52*a* on the lower hull 16*a*, the aft coupling 66*a* can include a locking mechanism 238. In the illustrated embodiment, the locking mechanism 238 operates between the sponson body 52*a* and the screw 216 of the drive mechanism. The locking mechanism 238, however, can be arranged alternatively to operate between the watercraft lower hull 16 and the screw 216.

Figure 14:
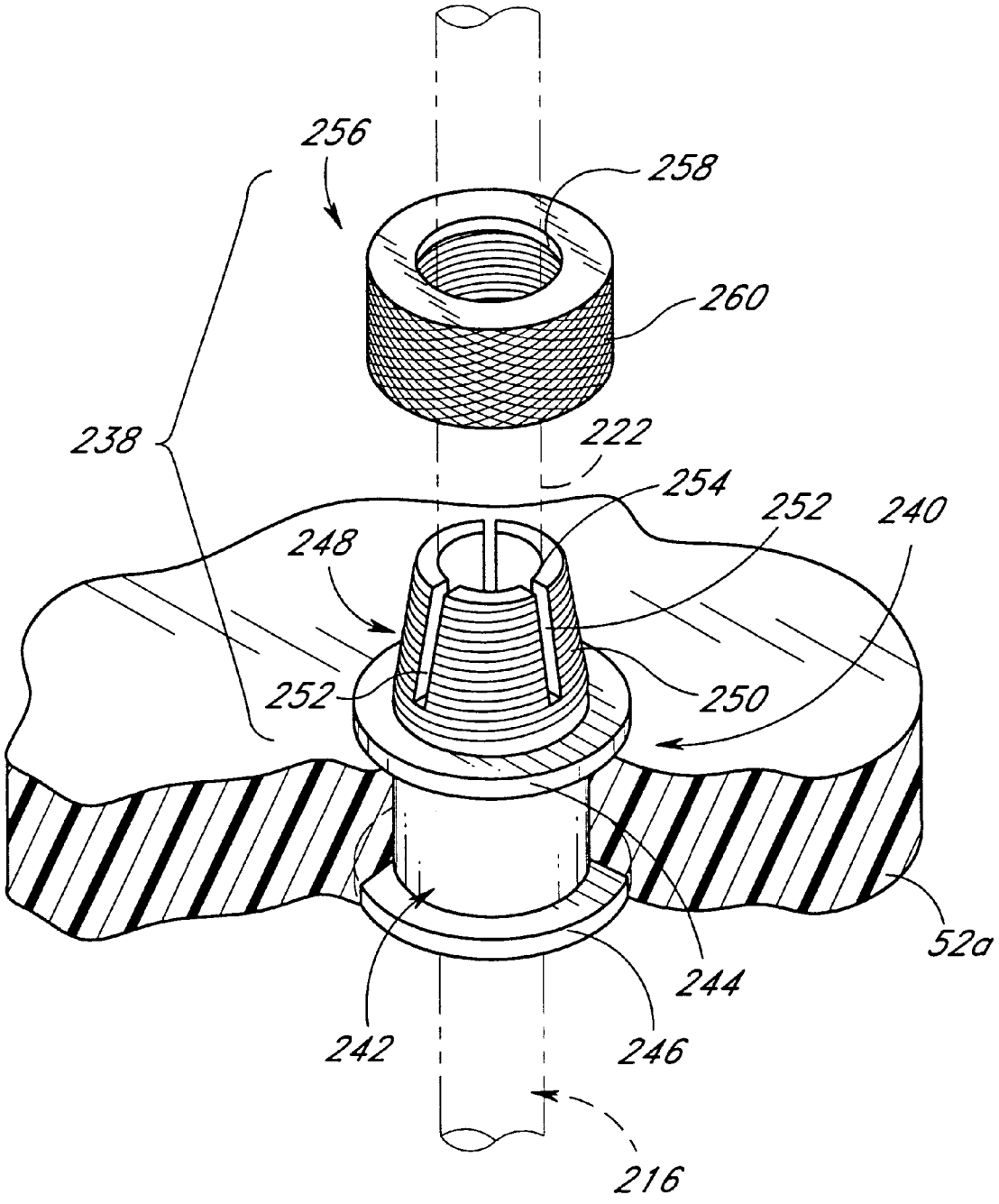
FIG. 14 is an enlarged, partial cross-sectional, perspective view of a locking mechanism of the rear coupling mechanism of FIGS. 12*a*.

In the illustrated embodiment, which is best seen in FIG. 14, the locking mechanism 238 includes a collet assembly 240. The collet assembly 240 includes a grommet 242 positioned within the upper aperture 217 of the sponson body 52*a*. Although in the illustrated embodiment the grommet 242 is molded into the sponson body 52*a*, the grommet 242 could, in the alternative, snap into or be integrally formed with the sponson body 52*a*.

The grommet 242 includes a pair of annular collars 244, 246 positioned at upper and lower ends of the grommet 242. The collars 246 anchor the grommet 242 to the sponson body 52*a* when molded together.

The screw 216 passes through the grommet's inner diameter as it extends to support the knob 218 above the sponson body 52*a*. The inner diameter of the grommet 242 desirably is slightly larger than the diameter of the screw shoulder 222. This difference in diameters provides a small amount of play, i.e., looseness, between the grommet 242 and the screw 216. The play permits the sponson body 52*a* to swing through the travel arc described above without interfering with the screw 216.

A collet 248 of the collet assembly 240 extends above the upper collar 244 of the grommet 242. The collet 248 is a cone-like, hollow sleeve with an inner diameter that is slightly larger than the diameter of the screw shoulder 222. The collet 248 also carries a thread 250 around at least a portion of its exterior.

At least one slit 252, and preferably a plurality of slits 252, extend from an upper end 254 of the collet 248 toward the grommet upper collar 244. The slits 252 desirably extend along axes which intersect with one another at a point on a longitudinal axis of the screw 216 above the collet 248. The slits 252 have a sufficient size to permit inward, radial deflection of the upper end 254 of the collet 248.

A locking nut 256 cooperates with the collet 248 to releasably fix the position of the screw 216 relative to the sponson body 52*a*. The nut 256 includes an inner threaded bore 258 with a thread size that matches that of the external thread 250 on the collet 248. The inner diameter of the bore 258 is larger than the diameters of the screw 216 and the upper end 254 of the collet 248; however, the inner bore diameter is smaller than the base diameter of the collet 248.

A knurl surface 260 covers the cylindrical exterior of the nut 256. The exterior cylindrical shape of the nut 256 desirably has a sufficient size to provide easy manipulation by one's fingers to tighten the nut 256 onto and loosen the nut 256 from the collet 248.

The locking nut 156 is positioned on the screw 216 and above the collet 248 when assembled. In a loosened state, the screw 216 freely rotates within the collet assembly 240. When the locking nut 256 is tightened on the collet 248, the locking nut 256 compresses the upper end 254 of the collet 248 in a radially inward direction toward the screw 216. The frictional contact between the inner surface of the collet sleeve 248 and the screw shoulder 222 prevents movement between these components. The screw 216 can not rotate relative to the sponson body 52*a*. The screw 216 of the drive mechanism, and thus the sponson body 52*a*, are locked in the established position. The nut 256, however, can be later loosened by the watercraft's rider to operate the drive mechanism.

The locking nut 156 and the collet assembly 240 desirably are made of the same material in order to inhibit galvanic corrosion. These components can be fabricated from any of a wide variety of rugged, marine-suitable materials, such as, for example, brass, aluminum, stainless steel, polyvinylchloride and the like.

Locking mechanisms also can be used with the fore and mid couplings 62*a*, 64*a*, in addition or in the alternative to the locking mechanism 238 of the aft coupling 66*a*, to further inhibit unintentional movement of the sponson body 52*a* relative to the lower hull 16*a*. For instance, the length of one or both of the spacers 78*a*, 92*a* can be reduced such that the washers 204, 210 presses against the inner surface of the corresponding sponson recess 76*a* 90*a*, thus locking the sponson body 52*a* in a particular orientation. Those skilled in the art therefore will readily appreciate that any of a variety of locking mechanisms can be used with the present coupling mechanism.

The foregoing description is that of preferred embodiments of the invention, and various changes and modifications may be made without departing from the spirit and scope of the invention. For instance, the coupling mechanism need not include a locking mechanism. The coupling mechanism can rather rely upon the inherent friction between the components of the couplings to maintain the set position of the sponson.

The drive mechanisms in the above-described embodiments also can be motor driven rather that manually operated. An operator of the watercraft could adjust the position of the sponsons 12 on the watercraft 10 by operating electric, hydraulic or similar motors using a control device located near the steering handle 40 of the operator controls 26.

Accordingly, although this invention has been described in terms of certain preferred embodiments, other embodiments apparent to those of ordinary skill in the art are also within the scope of this invention. The scope of the invention is intended to be defined only by the claims which follow.

What is claimed is:

1. A watercraft comprising a hull, at least one sponson and a coupling mechanism which attaches the sponson to the watercraft hull, the coupling mechanism including a guide mechanism that establishes a travel path for the sponson over a surface of the watercraft hull, a drive mechanism that moves the sponson along the travel path, and an actuator that drives the drive mechanism, the actuator being powered by a motor.

2. A watercraft as in claim 1, wherein the motor is an electric motor.

3. A watercraft as in claim 1, wherein the coupling mechanism further comprises a locking mechanism which selectively inhibits movement of at least a portion of the sponson body relative to the watercraft hull.

4. A watercraft as in claim 1, wherein the hull includes a chine, and the guide mechanism is arranged such that at least an aft end of the sponson moves along a travel path that varies the distance between the sponson aft end and the chine.

5. An adjustable sponson system for use with a watercraft hull comprising at least one sponson body and a coupling mechanism which attaches the sponson body to the watercraft hull, said coupling mechanism including a guide mechanism that principally defines a travel path for at least a portion of the sponson body over a surface of the hull, at least part of said coupling mechanism extending from said portion of said sponson body to couple with an adjacent surface of the watercraft hull so as to hold said sponson body portion in contact with the adjacent watercraft hull surface, and a motorized drive mechanism operable between the watercraft hull and the sponson body to move at least a portion of the sponson body along the travel path.

6. A watercraft as in claim 5, wherein the drive mechanism includes an electric motor.

7. A watercraft as in claim 5, wherein the coupling mechanism further comprises a locking mechanism which selectively inhibits movement of at least a portion of the sponson body relative to the watercraft hull.

8. A watercraft as in claim 5, wherein the hull includes a chine, and the guide mechanism is arranged such that at least an aft end of the sponson moves along a travel path that varies the distance between the sponson aft end and the chine.

* * * * *